US007743452B1

(12) United States Patent
Tcholakov

(10) Patent No.: US 7,743,452 B1
(45) Date of Patent: Jun. 29, 2010

(54) ADJUSTABLE BRISTLE TOOTHBRUSH APPARATUS

(76) Inventor: Stoyan I. Tcholakov, 397 Ventura Ave., Palo Alto, CA (US) 94306

( * ) Notice: Subject to any disclaimer, the term of this patent is extended or adjusted under 35 U.S.C. 154(b) by 791 days.

(21) Appl. No.: 11/626,006

(22) Filed: Jan. 23, 2007

(51) Int. Cl.
*A46B 9/04* (2006.01)

(52) U.S. Cl. ..... 15/201; 15/167.1

(58) Field of Classification Search ..... 15/167.1, 15/201, 21.1, 22.1, 22.2, 159.1, 160
See application file for complete search history.

(56) References Cited

U.S. PATENT DOCUMENTS 2,935,755 A * 5/1960 Leira et al. ..... 15/167.1
4,149,293 A 4/1979 Raaf et al.
4,152,806 A 5/1979 Raaf et al.
4,346,492 A * 8/1982 Solow ..... 15/22.1
5,315,732 A * 5/1994 Huefner et al. ..... 15/167.1
7,036,179 B1 * 5/2006 Weihrauch ..... 15/167.1
2004/0194238 A1 10/2004 Letendre

* cited by examiner

*Primary Examiner*—Laura C Guidotti
(74) *Attorney, Agent, or Firm*—Crossley Patent Law; Mark A. Crossley

(57) ABSTRACT

An adjustable bristle toothbrush apparatus which provides pneumatic bristle exposed length pressure adjustment. Bristles are provided in bristle bundles which are affixed to bristle bases. Each base moves within an individual cylinder via a slave piston. Adjustment of chamber pressure via the adjustment knob on the handle first end determines slave piston resistance to inward movement.

8 Claims, 3 Drawing Sheets

ADJUSTABLE BRISTLE TOOTHBRUSH APPARATUS

BACKGROUND OF THE INVENTION

Adjustments of both bristle length and bristle stiffness are desirable features of a toothbrush. Proper teeth cleaning is enhanced by this adjustability, and gum health also benefits. Stiffness of the bristles is correlated to length. Adjustable length, therefore, adjust bristle stiffness. Various bristle lengths are also a factor in properly reaching tooth surfaces of various heights of teeth, with respect to gums. Obviously, shorter height teeth require shorter bristles, and conversely longer teeth require longer bristles. The present apparatus solves these problems in teeth and gum health.

FIELD OF THE INVENTION

The adjustable bristle toothbrush apparatus relates to toothbrushes and more especially to a toothbrush with pneumatically adjustable bristle length and stiffness.

DESCRIPTION OF THE PRIOR ART

Prior related art does not provide the pneumatically adjustable bristle length and stiffness of the present apparatus. U.S. Pat. No. 4,152,806 issued to Raaf et al. on May 8, 1979 teaches a toothbrush with a slotted moveable perforated plate which is used to influence bristle stiffness. U.S. Pat. No. 4,149,293 issued to Raaf et al. on Apr. 17, 1979 teaches a toothbrush with moveable perforated plate as a means of influencing bristle stiffness. U.S. Pat. Publication No. 2004/0194238 issued to Letendre on Oct. 7, 2004 teaches a toothbrush having multiple selectable brushing surfaces.

While the above-described devices fulfill their respective and particular objects and requirements, they do not describe an adjustable bristle toothbrush apparatus that provides for the advantages of the present adjustable bristle toothbrush apparatus. In this respect, the present adjustable bristle toothbrush apparatus substantially departs from the conventional concepts and designs of the prior art. Therefore, a need exists for an improved adjustable bristle toothbrush apparatus.

SUMMARY OF THE INVENTION

The general purpose of the adjustable bristle toothbrush apparatus, described subsequently in greater detail, is to provide an adjustable bristle toothbrush apparatus which has many novel features that result in an improved adjustable bristle toothbrush apparatus which is not anticipated, rendered obvious, suggested, or even implied by prior art, either alone or in combination thereof.

To attain this, the adjustable bristle toothbrush apparatus provides bristles which are pneumatically adjustable. The pneumatic system of the apparatus is sealed. The adjustment knob on the end of the handle of the toothbrush, opposite the bristles, moves the master piston within a chamber of the handle. The piston thereby selectively compresses air within the chamber and within individual cylinders which are in communication with the chamber. Cylinders are disposed below bristle bundles, which are each supported by a bundle base. Each bundle base is affixed to a slave piston. Each slave piston moves individually within each individual cylinder.

The pneumatic adjustability of each bristle bundle pushes each bundle base and hence each bristle bundle outwardly from the brush head. The farther the master piston is pushed within the chamber, the more outward pressure applied to each bundle. As the pressure is adjustable, the user selectively chooses how much pressure from teeth is required against bristles to cause bristles to retreat. As example, vigorous tooth brushing technique might cause bristles in contact with molars to retreat back into the head somewhat, while those bristles not in direct contact with the face of a molar are allowed to remain fully outward, thereby better reaching the sides of molars and other teeth. Those bristles in retreat become stiffer, as less flexible bristle base length is exposed. The pressure adjustability thereby allows a user to choose just how the bristles contact teeth and gums.

Thus has been broadly outlined the more important features of the improved adjustable bristle toothbrush apparatus so that the detailed description thereof that follows may be better understood and in order that the present contribution to the art may be better appreciated.

An object of the adjustable bristle toothbrush apparatus is to provide improved dental hygiene.

Another object of the adjustable bristle toothbrush apparatus is to provide adjustable bristle length.

A further object of the adjustable bristle toothbrush apparatus is to user adjustable bristle length.

An added object of the adjustable bristle toothbrush apparatus is to provide user adjustable bristle rigidity These together with additional objects, features and advantages of the improved adjustable bristle toothbrush apparatus will be readily apparent to those of ordinary skill in the art upon reading the following detailed description of presently preferred, but nonetheless illustrative, embodiments of the improved adjustable bristle toothbrush apparatus when taken in conjunction with the accompanying drawings.

In this respect, before explaining the current embodiments of the improved adjustable bristle toothbrush apparatus in detail, it is to be understood that the adjustable bristle toothbrush apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved adjustable bristle toothbrush apparatus. It is therefore important that the claims be regarded as including such equivalent constructions insofar as they do not depart from the spirit and scope of the adjustable bristle toothbrush apparatus. It is also to be understood that the phraseology and terminology employed herein are for purposes of description and should not be regarded as limiting.

DETAILED DESCRIPTION OF THE DRAWINGS

Figure 1:
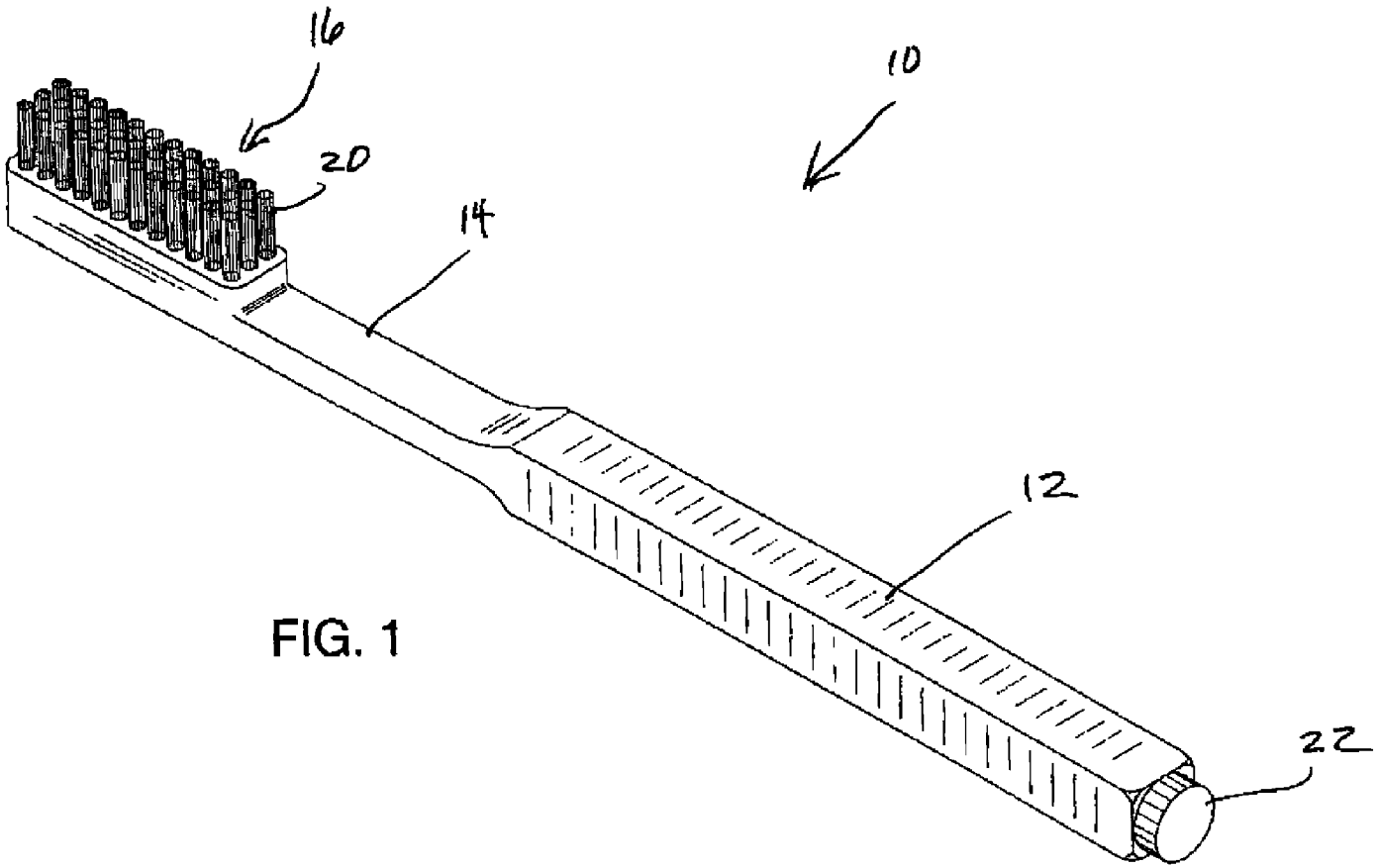
FIG. 1 is a perspective view.
Figure 2:
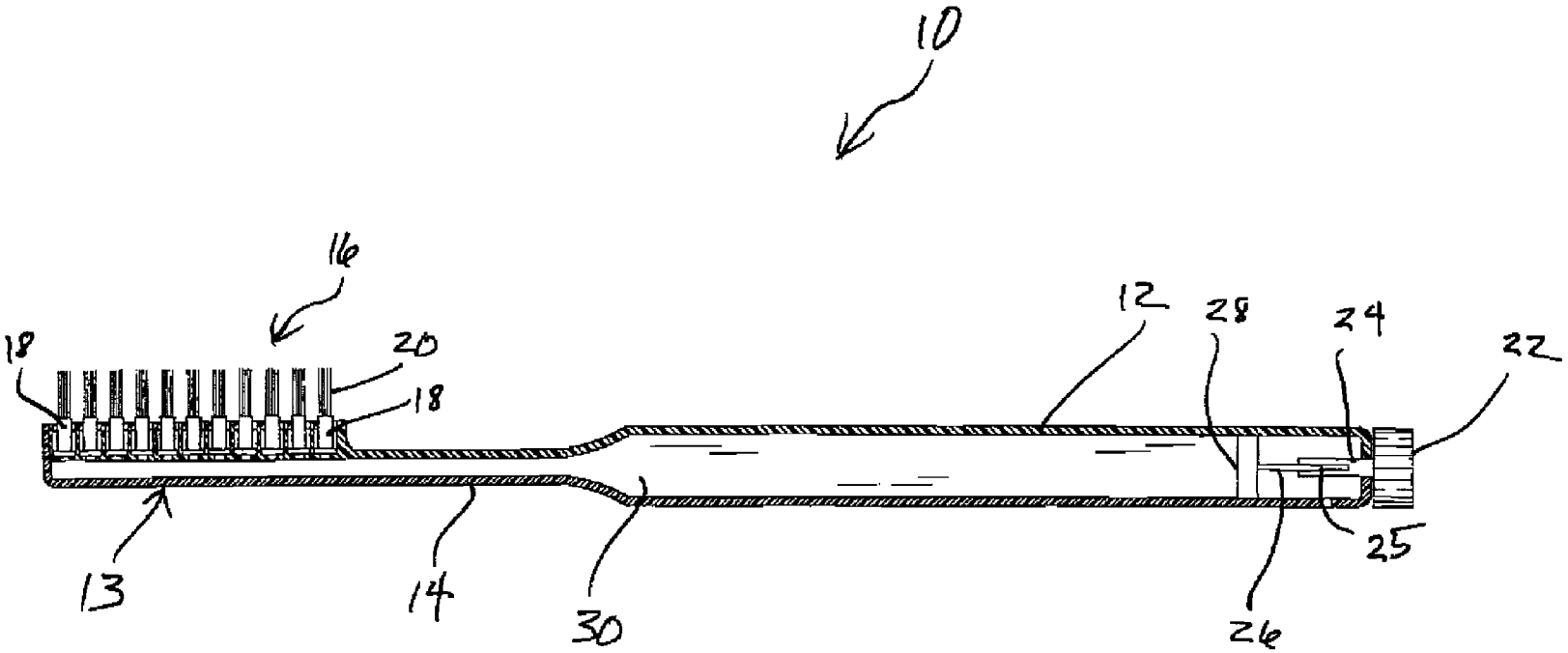
FIG. 2 is a cross sectional view.
Figure 3:
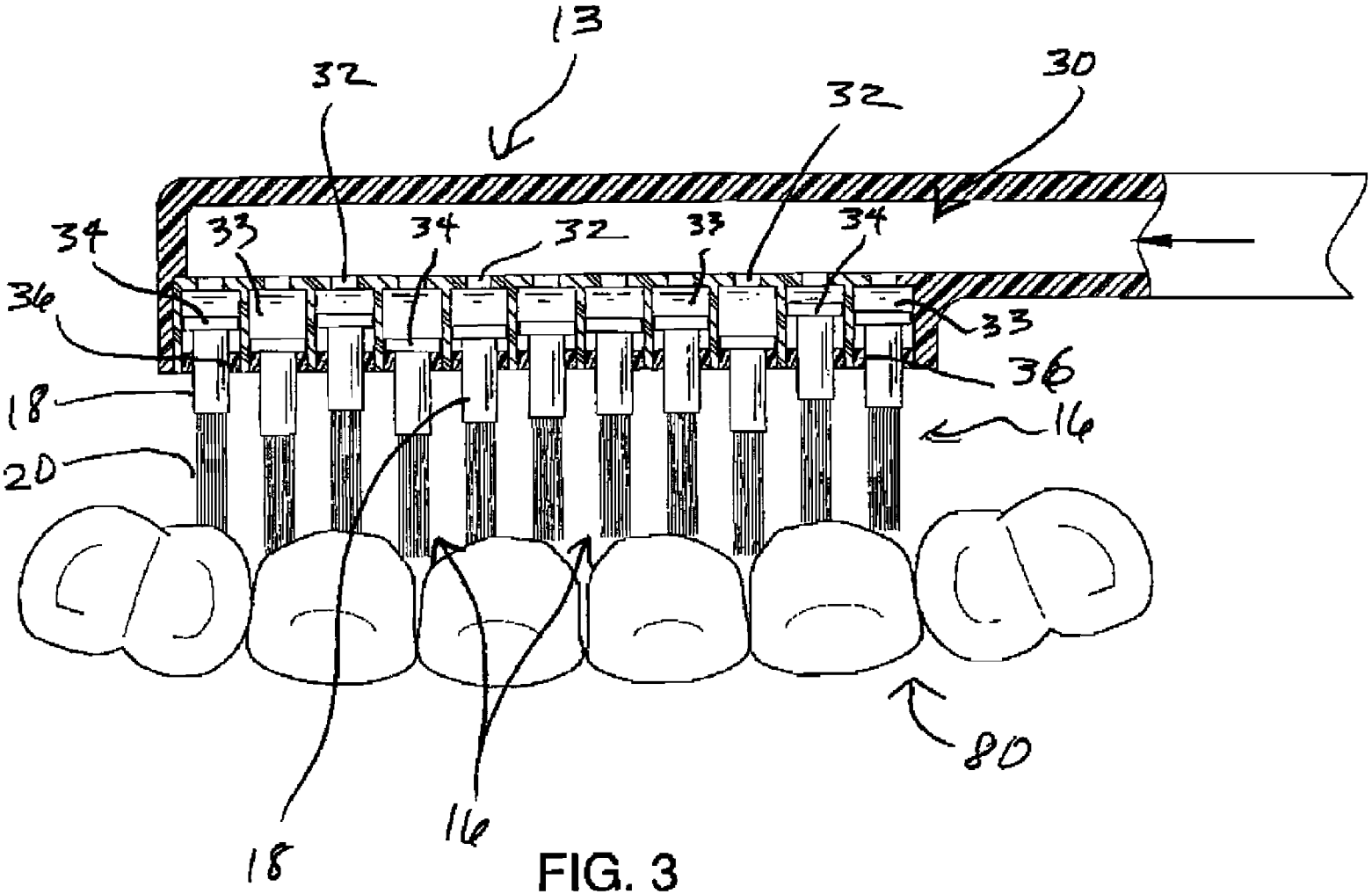
FIG. 3 is cross sectional view of the head.

With reference now to the drawings, and in particular FIGS. 1 through 3 thereof, the principles and concepts of the adjustable bristle toothbrush apparatus generally designated by the reference number 10 will be described.

Referring to FIGS. 1, 2, and 3, the pneumatically adjustable toothbrush apparatus 10 comprises an elongated handle 12. The handle 12 has a first end and a second end. The neck 14 is affixed to the second end of the handle 12. The head 13 is affixed to the neck 14. The neck 14 further comprises a thickness less than a thickness of the handle 12. The narrowed neck 14 provides easier oral accessibility for the user. The bottom side of the head 13 is coplanar with the bottom side of the neck 14, which further yields improved oral accessibility for the user. The handle 12 is rectangularly shaped for best grip. The round adjustment knob 22 provides tactile differentiation from the handle 12. A pneumatic chamber 30 is disposed within the handle 12, the neck 14, and the head 13. The adjustment knob 22 is rotatably affixed to the first end of the handle 12. The shaft 24 is affixed to an interior of the adjustment knob 22. The shaft 24 is sealably fitted within the chamber 30 of the handle 12 via the first end of the handle 12. Female thread 25 is disposed within the shaft 24.

The master piston 28 is slideably fitted within the chamber 30. The master piston 28 is incapable of rotation within the chamber 30. The threaded piston rod 26 connects the master piston 28 to the shaft 24 via the female thread 25 of the shaft 24.

In detailed view of the head 13 in FIGS. 2 and 3, a plurality of pneumatic cylinders 33 is disposed within the head 13. Each cylinder 33 is in communication with the chamber 30. A slave piston 34 is slideably disposed within each cylinder 33. An orifice 32 is disposed between each cylinder 33 and the chamber 30. A plurality of bristles 16 having bristle bases 18 is provided. Each bristle base 18 has a first end and a second end. Each first end of each bristle base 18 is affixed to one slave piston 34. A bristle bundle 20 is affixed to each bristle base 18 second end. Each bristle bundle 20 is comprised of a plurality of bristles 20. A passage 36 is disposed in each cylinder 33. One bristle base 18 is slideably and sealably disposed within each passage 36.

In use, a user rotates the knob 22 to affect pressure increase or decrease in the chamber 30. The lowest pressure setting within the chamber 30 is experienced with the knob 22 turned to position the master piston 28 closest to the first end of the handle 12. This pressure setting provides easy inward and outward movement of the slave pistons 34 and hence the bristle bundles 20. The highest pressure is achieved within the chamber 30 by rotating the knob 22 to position the master piston 28 farthest from the first end of the handle 12. High chamber 30 pressure resists inward movement of the slave pistons 34 and thereby positions bristles 16 farthest outwardly. The adjustability enhances proper teeth 80 cleaning.

With respect to the above description then, it is to be realized that the optimum dimensional relationships for the parts of the adjustable bristle toothbrush apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the adjustable bristle toothbrush apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the adjustable bristle toothbrush apparatus may be used.

Therefore, the foregoing is considered as illustrative only of the principles of the adjustable bristle toothbrush apparatus. Further, since numerous modifications and changes will readily occur to those skilled in the art, it is not desired to limit the adjustable bristle toothbrush apparatus to the exact construction and operation shown and described, and accordingly, all suitable modifications and equivalents may be resorted to, falling within the scope of the adjustable bristle toothbrush apparatus.

What is claimed is:

1. A pneumatically adjustable toothbrush apparatus comprising:

an elongated handle having a first end and a second end;

a neck affixed to the second end of the handle;

a head affixed to the neck;

a pneumatic chamber within the handle, the neck, and the head;

an adjustment knob rotatably affixed to the first end of the handle;

a shaft affixed to an interior of the adjustment knob, the shaft sealably fitted within the chamber of the handle;

a female thread within the shaft;

a master piston slideably fitted within the chamber, the master piston incapable of rotation;

a threaded piston rod connecting the master piston to the shaft;

a plurality of pneumatic cylinders within the head, each cylinder in communication with the chamber;

a slave piston within each cylinder;

a plurality of bristle bases, each bristle base having a first end and a second end, each first end affixed to one slave piston;

a bristle bundle affixed to each bristle base second end;

a passage in each cylinder, one bristle base slideably and sealably disposed within each passage.

2. The apparatus in claim 1 wherein the neck further comprises a thickness less than a thickness of the handle.

3. The apparatus in claim 2 wherein handle is rectangularly shaped.

4. The apparatus in claim 2 wherein a bottom side of the head is coplanar with a bottom side of the neck.

5. The apparatus in claim 4 wherein handle is rectangularly shaped.

6. The apparatus in claim 1 wherein a bottom side of the head is coplanar with a bottom side of the neck.

7. The apparatus in claim 6 wherein handle is rectangularly shaped.

8. The apparatus in claim 1 wherein handle is rectangularly shaped.

* * * * *